US005975458A

United States Patent [19]

Goldthreate

[11] Patent Number: 5,975,458

[45] Date of Patent: Nov. 2, 1999

[54] DEVICE TO STORE AND FEED YARN

[76] Inventor: Ann Goldthreate, 309 Claymille Pl., Nashville, Tenn. 37207

[21] Appl. No.: 09/066,179

[22] Filed: Apr. 24, 1998

[51] Int. Cl.[6] ..... B65H 75/18; B65H 75/10; B65H 59/22

[52] U.S. Cl. ..... 242/603; D3/23; 242/118.3; 242/139

[58] Field of Search ..... 242/118.3, 139, 242/603, 594.3, 130.4; D3/23, 24

[56] References Cited

U.S. PATENT DOCUMENTS

| | | | |
|---|---|---|---|
| D. 235,282 | 6/1975 | Langston, Jr. . | |
| D. 281,831 | 12/1985 | White | D3/23 |
| D. 292,643 | 11/1987 | Dick et al. | D3/24 |
| D. 334,835 | 4/1993 | Randolph | D3/23 |
| 843,190 | 2/1907 | Wilson . | |
| 1,168,940 | 1/1916 | Fisher . | |
| 1,214,172 | 1/1917 | Kinney . | |
| 1,469,266 | 10/1923 | Needham . | |
| 1,511,005 | 4/1924 | Powers . | |
| 1,646,198 | 10/1927 | Ham | 242/118.3 |
| 2,330,702 | 9/1943 | Goldschmidt | 242/139 |
| 3,361,381 | 1/1968 | Livingstone | 242/118.3 |
| 3,532,291 | 10/1970 | Newman | D3/23 |
| 4,036,418 | 7/1977 | Chlebda | 242/139 X |
| 4,081,154 | 3/1978 | Miszkwitz, Jr. . | |
| 4,596,366 | 6/1986 | Dick et al. | 242/118.3 |
| 4,921,185 | 5/1990 | Baker . | |
| 5,222,677 | 6/1993 | Sarfati . | |

FOREIGN PATENT DOCUMENTS

| | | |
|---|---|---|
| 621253 | 5/1927 | France . |
| 1151846 | 2/1958 | France . |

*Primary Examiner*—Michael R. Mansen
*Attorney, Agent, or Firm*—Richard C. Litman

[57] ABSTRACT

A spool adapted for holding and dispensing yarn for crocheting and knitting. The spool is substantially cylindrical, with a gradual slope toward the two ends. The slightly bulging middle portion is circumferentially lined with closely spaced ridges adapted for preventing slippage of the yarn wrapped thereon. Each of the two ends of the spool has four integrally formed peripheral feet which enable the holder to be oriented in a vertically stable position using either end as the base. A support stand is optionally provided which is adapted for holding the spool in a vertical position, has a base which includes four vertical handles establish a perimeter around the four feet disposed at the end of the spool. A fifth, longer vertical handle, centrally disposed on the base, is sized in length to permit single handed carrying of the stand with a plurality of spools placed thereon. The spool is allowed to spin freely on the post of the stand in a stable manner.

7 Claims, 3 Drawing Sheets

DEVICE TO STORE AND FEED YARN

BACKGROUND OF THE INVENTION

1. Field of the Invention

The present invention relates generally to thread and yarn bobbins. More specifically, the invention is a manually operated spool provided with a plurality of ridges adapted for holding and dispensing yarn for crocheting and knitting.

2. Description of the Related Art

When one is crocheting or knitting, the yarn often becomes tangled. To prevent this from happening, one typically wraps the yarn around some sort of spooling device or has an assistant that is willing to sit with the yarn wrapped around his hands, which acts as a spool. The major drawback of the typical spools is that the yarn is not held securely on the spool and more yarn generally feeds out than necessary, causing the yarn to become quickly tangled. What is needed is a spool that holds the yarn securely in place, but allows the yarn to feed out easily when needed.

Several patents have addressed the general field of spools for yarn and thread. U.S. Pat. No. Des. 235,282 issued on Jun. 3, 1975 to Langston, Jr. depicts a conical yarn spool with a flat base. Langston, Jr. fails to depict an externally wound spool with rounded ends which facilitates the use of the spool without concern for stability of the spool when resting.

U.S. Pat. No. Des. 281,831 issued on Dec. 24, 1985 to White depicts a yarn holder which is rounded in shape. The yarn holder appears to be internally wound such that the yarn feeds out from the inside of the holder. White does not depict an externally wound yarn holder with a ridged surface as in the present invention.

U.S. Pat. No. Des. 292,643 issued on Nov. 10, 1987 to Dick et al. depicts a yarn bobbin with an externally threaded shaft and a flat base. Dick et al. does not depict an externally wound spool with rounded ends which facilitates the use of the spool without concern for stability of the spool while at rest.

U.S. Pat. No. Des. 334,835 issued on Apr. 20, 1993 to Randolph depicts a core holder for yarn which is essentially a conical spool having at most four ribs on its outer surface. The spool is not able to stand in a stable fashion on either end or on its side as in the present invention.

U.S. Pat. No. 1,168,940 issued on Jan. 18, 1916 to Fisher discloses a spool with projections extending outwardly from the heads of the spool to prevent it from rolling. Fisher teaches away from the present invention wherein the spool is intended to roll easily along a single axis.

U.S. Pat. No. 1,469,266 issued on Oct. 2, 1923 to Needham discloses a spool holder which has a hooked end which can be used as a handle and draped over the arm of the person who is crocheting or knitting. Needham does not teach or describe a spool as in the present invention.

U.S. Pat. No. 1,511,005 issued on Oct. 7, 1924 to Powers discloses a holder for thread spools or balls of yarn. The object of the invention in Powers is to prevent the spool or ball of yarn from rolling around which is contrary to the object of the present invention.

U.S. Pat. No. 4,081,154 issued on Mar. 28, 1978 to Miszkwitz, Jr. discloses a yarn dispenser having a housing in which a supply of yarn is wound onto a bobbin-like pin and confined by the housing to preclude entanglement. The yarn is withdrawn axially through a hole in the housing. The drawback to the Miszkwitz invention is that it is not easily transportable as is the present invention.

U.S. Pat. No. 4,921,185 issued on May 1, 1990 to Baker discloses an assembly for holding and dispensing yarn from a skein of yarn. There is a flexible bin which can be used to store yarn and assorted working implements. Disposed above the bin is a spindle on which yarn can be wound for easy removal. The drawback to the Baker invention is that it is not easily transportable as is the present invention.

French Patent No. 621,253 published on May 9, 1927 discloses a narrow cylindrical spool around which a ball of yarn can be placed. The French Patent does not disclose a spool with ridges along its outer edge for holding the yarn securely in place.

French Patent No. 1,151,846 published on Feb. 6, 1958 discloses a yarn holder that has a swivel ring that can be used as a handle which can be placed over the user's wrist for support. The French Patent does not disclose a spool as in the present invention.

Other patents have issued which are only generally related to the present invention include U.S. Pat. No. 843,190 (Thread Guard) issued on Feb. 5, 1907 to Wilson; U.S. Pat. No. 1,214,172 (Device for Use in Crocheting and Other Work) issued on Jan. 30, 1917 to Kinney; and U.S. Pat. No. 5,222,677 (Apparatus and Method for the Drawing off of Threads, Ribbons, and the Like) issued on Jun. 29, 1993 to Sarfati.

None of the above inventions and patents, taken either singularly or in combination, is seen to describe the instant invention as claimed. Thus a device to store and feed yarn solving the aforementioned problems is desired.

SUMMARY OF THE INVENTION

The present invention is a manually operated spool adapted for holding and dispensing yarn for crocheting and knitting. The device is substantially cylindrical, with a gradual slope toward the two ends. The slightly bulging middle portion is circumferentially lined with closely spaced ridges for preventing slippage of the yarn wrapped thereon. Each of the two ends of the spool has four integrally formed peripheral feet which enable the spool to be oriented in a vertically stable position using either end as the base. A central longitudinal bore passes from end to end of the spool.

An optional support stand is provided, which is adapted for holding the spool in a vertical position. Its base includes four vertical support members, each establishing an axle for insertion into the bore of a different spool, each spool thereby resting on the four feet on a different portion of the base of the support stand. A fifth, longer vertical support member, centrally disposed on the base, is sized to serve as a carrying handle of the support stand. Each spool is thus allowed to spin freely on the stand in a stable manner.

Accordingly, it is a principal object of the invention to provide a spool that is able to be used by standing it on either end or by resting it on its side.

It is another object of the invention to provide a spool that is lightweight, durable, and easily transported.

It is a further object of the invention to provide a spool that holds yarn securely in place until such time it is intended to be unraveled.

Still another object of the invention is to provide a spool that is easily unwound.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
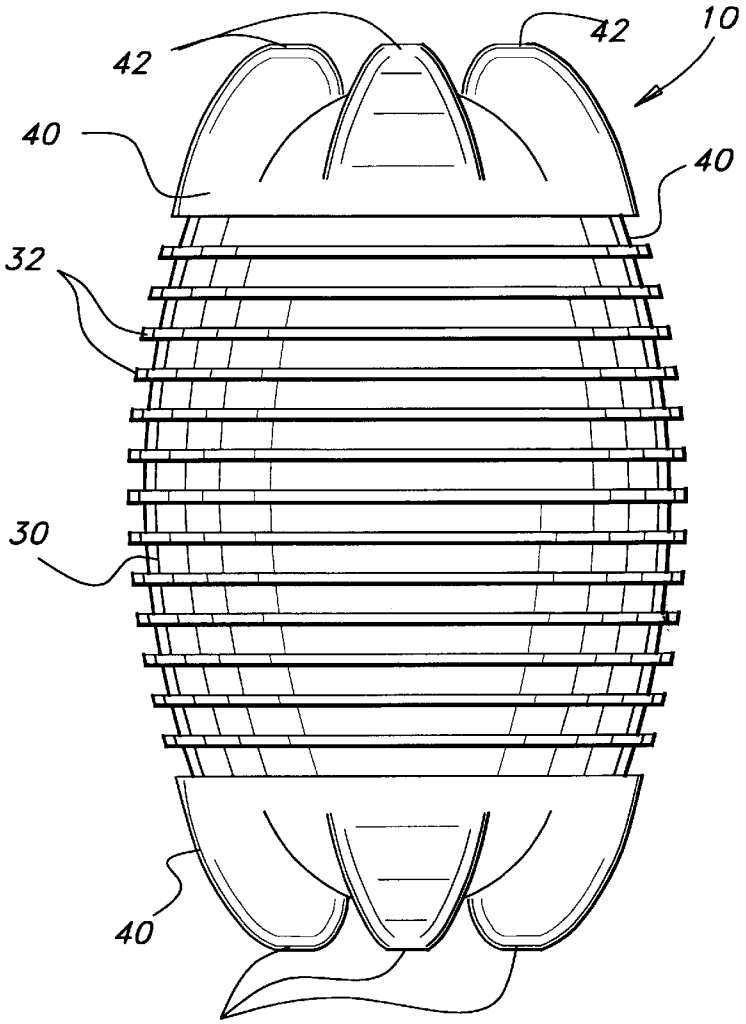
FIG. 2 is a side view of the spool according to FIG. 1.
Figure 1:
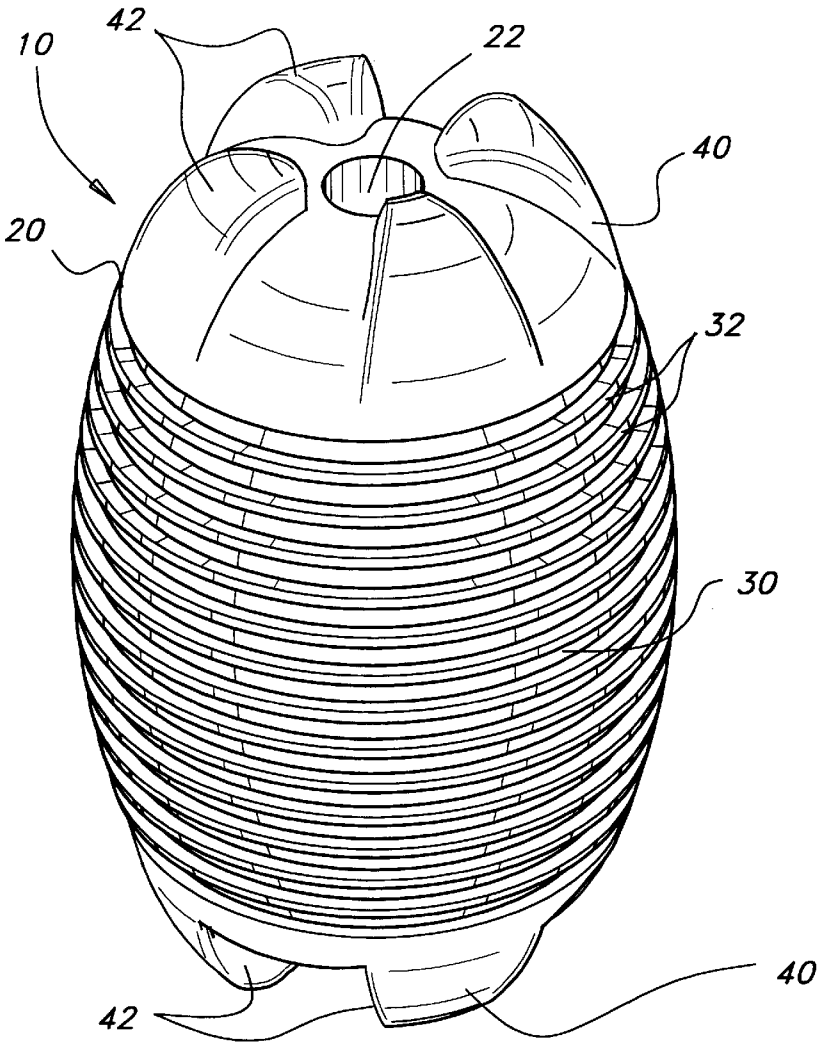
FIG. 1 is a perspective view of a spool to store and feed yarn according to the present invention.

The present invention is an spool 10 for storing and feeding yarn which comprises a body 20 having identical ends 40 and a center portion 30. The body 20 is substantially cylindrical having a gradual slope toward each end 40 such that the center portion 30 of the body 20 is slightly bulging. The center portion 30 is provided with a plurality of external equidistant annular ridges 32 provided for preventing the slippage of yarn 5 wound thereon. The body 20 defines a bore 22 through its center which spans the length of the body 20 between the ends 40.

The identical ends 40 are integrally formed with the center portion 30 and are provided with four integrally formed feet 42. The feet 42 terminate in the same plane and thereby define a flat end 40, allowing the device 10 to be stood on either end 40. The device 10 is constructed from lightweight material to enable a user to carry it around easily. The device 10 can simply be stood on either end 40 or set down such that it rests on its side; regardless of position, the device 10 will still permit unraveling of the yarn as needed.

Figure 3:
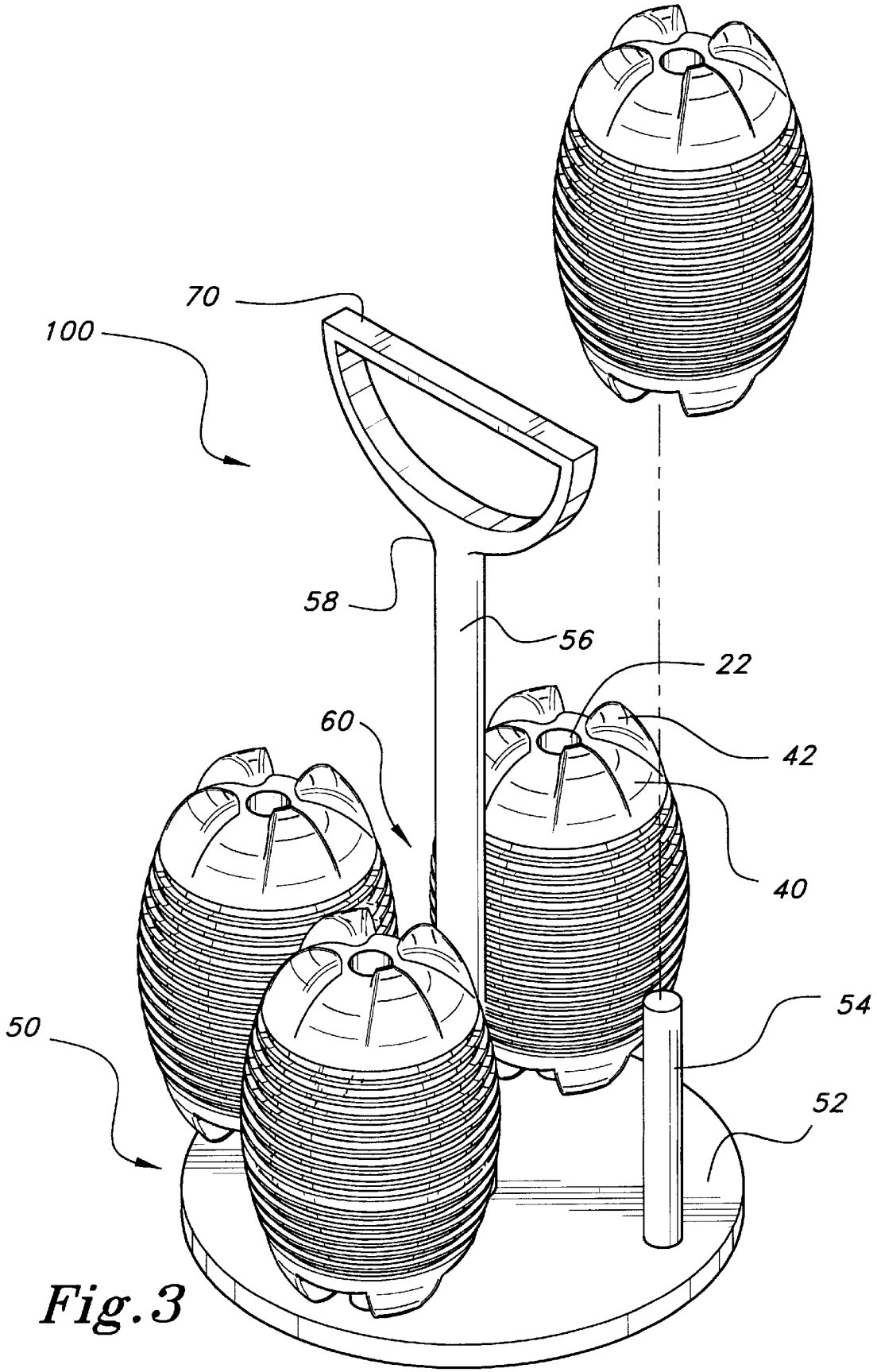
FIG. 3 is a partially exploded view of a plurality of spools in combination with the support stand according to the present invention.
Figure 4:
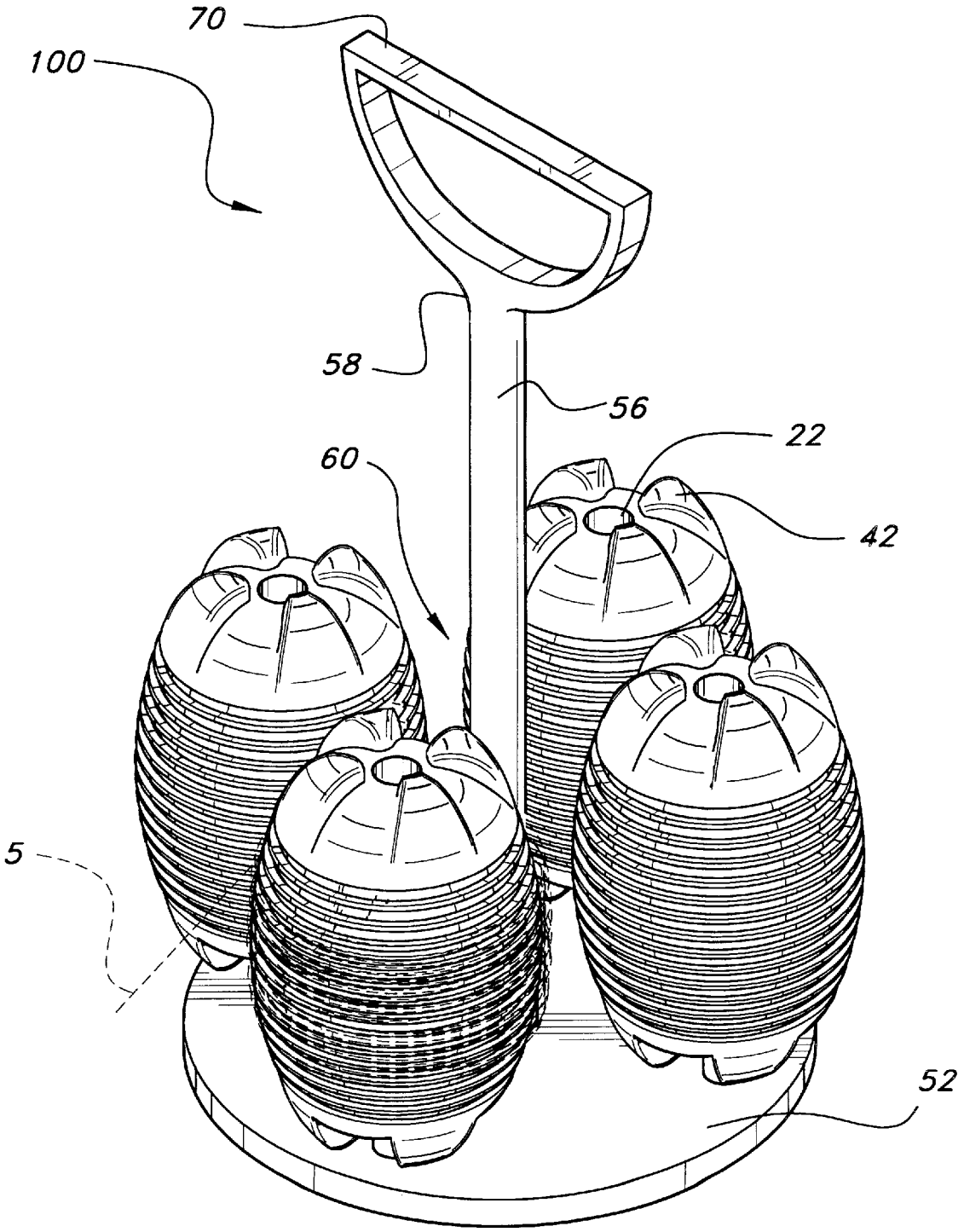
FIG. 4 is a perspective view of the device to store and feed yarn utilizing the stand according to the present invention.

The assembly 100 according to the present invention comprises support stand 50 seen in FIGS. 3 and 4 as well as a plurality of spools 10. The support stand 50 comprises a base member 52, four vertical support posts 54 which extend upwardly perpendicular from the base 52, and a main handle 56 having a first end 58 and a second end 60. The main handle 56 is attached at its second end 60 to the base member 52. The first end 58 of the main handle 56 is provided with a handle grip 70 thereon for convenient single-hand carrying.

As can be seen from FIG. 3, each post 54 passes through the bore 22 in the center of the body 20 of spool 10 permitting axial rotation and removal of the spool as desired. The posts 54 and spools 10 are arranged about the perimeter of base 52 around the handle 56, thereby permitting the spools 10 when placed on the support stand to evenly balance it.

The body 20 and the stand 50 are manufactured in a variety of colors for decoration or such that they can match the color of the yarn 5 to be wound thereon. Each spool 10 can be made of inexpensive materials such that one may purchase several, thus obviating the need to continuously rewind yarn 5 when switching colors.

It is to be understood that the present invention is not limited to the embodiments described above, but encompasses any and all embodiments within the scope of the following claims.

I claim:

1. A spool to store and feed yarn comprising:

a body having identical ends, a substantially cylindrical center portion integrally formed between said ends, said center portion having an inwardly gradual slope toward each of said ends such that said center portion is bulging outwardly, and a plurality of annular ridges equidistantly spaced on said center portion and defining a plurality of channels therebetween for receiving yarn wound onto said spool.

2. The spool according to claim 1, wherein said ends are provided with four integrally formed feet.

3. The spool according to claim 1, wherein said spool defines a bore through its center extending from one end to the opposite end.

4. The spool according to claim 3 further comprising:

a support stand having a base member;

a handle depending perpendicularly from the center of said base member; and four vertical support posts extending upwardly perpendicular from said base member and sized to be rotatably received by said bore of said spool.

5. The spool according to claim 4, wherein said handle further comprises a handle grip for single-handed carrying of said support stand.

6. A spool assembly in combination comprising:

a plurality of spools to store and feed yarn, each comprising a body having identical ends, a substantially cylindrical center portion integrally formed between said ends and defining a bore through its center extending from one end to the opposite end, said center portion having an inwardly gradual slope toward each of said ends such that said center portion is bulging outwardly, each end provided with four integrally formed feet;

a plurality of annular ridges equidistantly spaced on said center portion and defining a plurality of channels therebetween for receiving yarn wound onto said spool; and a support stand having a base member;

a handle depending perpendicularly from the center of said base member; and four vertical support posts extending upwardly perpendicular from said base member and sized to be rotatably received by said bore of said spool.

7. The spool according to claim 6, wherein said handle further comprises a handle grip for single-handed carrying of said support stand.

* * * * *